United States Patent [19]

Niemeyer

[11] 4,298,116

[45] Nov. 3, 1981

[54] STRING DETECTOR FOR A COIN-SELECTING DEVICE

[75] Inventor: John F. Niemeyer, St. Louis, Mo.

[73] Assignee: Coin Acceptors, Inc., St. Louis, Mo.

[21] Appl. No.: 85,582

[22] Filed: Oct. 17, 1979

[51] Int. Cl.[3] ..... G07F 1/00

[52] U.S. Cl. ..... 194/97 R; 194/1 E; 194/1 K

[58] Field of Search ..... 194/1 E, 1 K, 97 R

[56] References Cited

U.S. PATENT DOCUMENTS

| | | | |
|---|---|---|---|
| 2,332,018 | 10/1943 | Shann | 194/97 R X |
| 2,683,517 | 7/1954 | Gabrielsen | 194/97 R |
| 3,279,574 | 10/1966 | Seiden | 194/97 R X |
| 3,998,309 | 12/1976 | Mandas et al. | 194/97 R |

*Primary Examiner*—F. J. Bartuska

*Attorney, Agent, or Firm*—Cohn, Powell & Hind

[57] ABSTRACT

A string detector for a coin-selecting device in which a switch is conditioned to a first state by a string attached to a coin inserted into the device, and conditioned to a second state by the absence of a string, and a coin validator normally conditioned to a first state, and conditioned to a second state by a valid coin. The switch and coin validator are operatively interconnected for determining the handling of the coin depending upon the states of the switch and the coin validator. More particularly, a start-reset timer is provided having a predetermined time interval in which the timer must be started by a coin conditioning the switch to the said first state and subsequently reset by conditioning the switch to the second state, the timer providing an output when the predetermined time interval is exceeded without having the timer reset as is caused by maintaining the switch in the said first state by the presence of a string attached to the coin. The coin validator provides an output when conditioned to said second state by a valid coin. A sensor senses the output of the timer and coin validator for determining the handling of the coin by the device. The sensor can be a logic circuit that can cause different manners of handling the coin in the device at this stage, depending upon the existence of a timer output.

6 Claims, 12 Drawing Figures

STRING DETECTOR FOR A COIN-SELECTING DEVICE

BACKGROUND OF THE INVENTION

This invention relates generally to an improved string detector for a coin-sensing device, and more particularly to an improved assembly for detecting the presence or absence of a string, and to an improved string detector that includes means operatively interconnecting a switch means conditioned to a first or second state by the presence or absence of a string, and a coin validation means conditioned from one state to a second state by a valid coin, for determining the handling of the coin depending upon the states of the switch means and coin validation means.

It is well known that persons will attempt to cheat a vending machine or the like controlled by a coin-accepting device by inserting a coin with a string attached. By manipulation of the coin with the string, such persons will attempt to control the coin in its passage through the coin-accepting device so that undeserved monetary credits will be given and vending of products from the vending machine will be realized without the appropriate amount of money being inserted into the coin-accepting device. The string also permits the coin for this unlawful purpose to be retrieved by the user.

There are many prior art devices that tend to discourage the use of a string attached to a coin for this objectionable, illegal purpose. For example, there are devices that include cutters that sever the string and preclude the manipulation of the coin. Other devices limit movement of a valid coin after one appropriate switch actuation for credit purposes incident to vending, and thereby preclude subsequent credit by the same coin. There are still other devices that grip and hold the string to preclude any movement of the string after the coin is inserted. This latter type of device is objectionable in that it usually requires servicing of the device to release and remove the string.

SUMMARY OF THE INVENTION

The present string detector does not sever the string, and does not grip or hold the string to preclude any movement as described above with respect to certain items of prior art. Consequently, the present string detector avoids the need for servicing of the coin-selecting device to remove the string. Moreover, the present string detector enables many more options in how to handle a coin having a string attached, i.e., passing the coin into the cash box or returning the coin to the customer.

In the present string detector, a switch means is conditioned to a first state by a string attached to a coin inserted into the coin-selecting device, and conditioned to a second state by the absence of a string. A coin validation means is normally conditioned to a first state, and is conditioned to a second state by a valid coin. The switch means and coin validation means are operatively interconnected for determining the handling of the coin by the device depending upon the states of the switch means and coin validation means.

In one embodiment, the coin validation means provides an output when both the switch means and the coin validation means are in the said second state, the output being precluded when either the switch means or the coin validation means are in said first state.

In another embodiment, the means operatively interconnecting the switch means and coin validation means includes a start-reset timer means having a predetermined time interval in which the timer means must be started by a coin conditioning the switch means to the said first state and subsequently reset by conditioning the switch means to the second state, the timer means providing a timer output when a predetermined time interval is exceeded without having the timer means being reset which is caused by maintaining the switch means in the said first state by the presence of a string attached to the coin. A coin validation means provides an output when conditioned to the second state by a valid coin. Means is provided for sensing the outputs of the timer means and the coin validation means for determining the handling of the coin by the device. Preferably, the means sensing the outputs is a logic means that can cause different manners of handling coins in the device depending upon the existence of a timer means output.

The present string detector includes a switch means having a movably mounted switch member movable from one position for conditioning the switch means to said first state upon engagement with the coin for starting the timer means, and movable back to said one position upon disengagement of the coin when a string is absent for conditioning the switch means to said second state for resetting the timer means within the predetermined time interval. Moreover, the movably mounted switch member is precluded from returning to the said one position by engagement with a string for maintaining the switch means in said first state and precluding reset of the timer means within the predetermined time interval, and thereby causing a timer means output.

In the present string detector, the movable switch member and cooperating chute means are provided with compatible ribs and grooves selectively interfitting in one position of the switch member when a string is absent from between the ribs and grooves for conditioning the switch means to the second state, the switch member being held from said one position by the engagement of a string between the ribs and grooves for conditioning the switch means to said first state.

A cam of the movable switch member extends into the chute and is engageable by the coin for moving the switch member from said one position for allowing passage of the coin along the chute and between the ribs and grooves, the switch member being biased and tending to move back to said one position.

Preferably, in the present string detector, the switch means includes an optical limit switch conditioning the switch means to the said first state by the switch member when moved from said one position by a coin to start the timer means, and conditioning the switch means to said second state by the switch member when moved back to said one position after passage of the coin in the absence of a string to reset the timer means within the predetermined time interval. Moreover, the optical limit switch maintains the switch means conditioned in said first state as the switch member is precluded from moving back to said one position by engagement with a string.

DESCRIPTION OF THE PREFERRED EMBODIMENT

Figure 6:
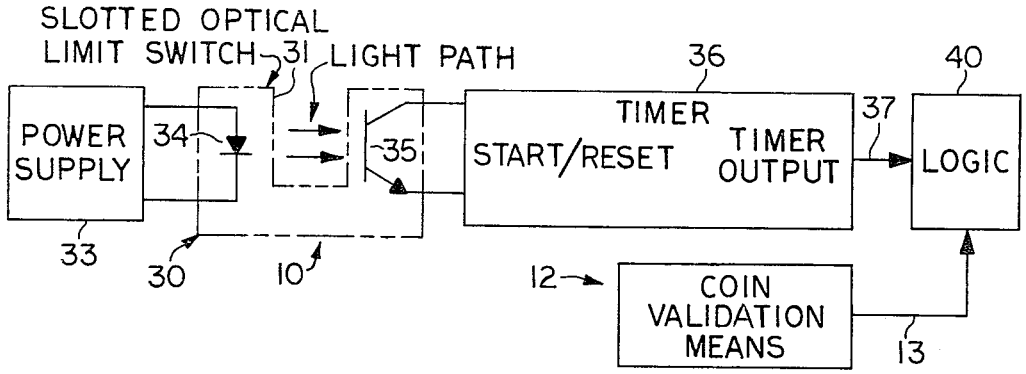
FIG. 6 is a block diagram of a circuit for use as the string detector in a coin-selecting device.
Figure 10:
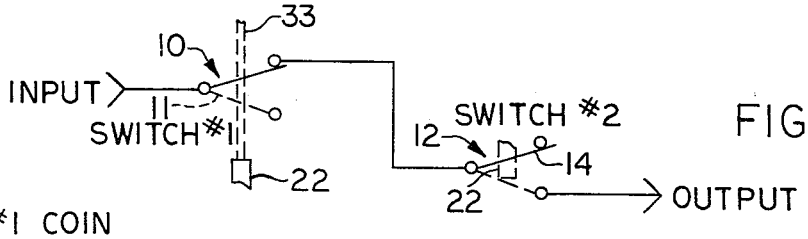
FIG. 10 is a schematic circuit diagram of another embodiment of the string detector.

Referring now by characters of reference to the drawings. and first to the block diagram of FIG. 6 and to the circuit diagram of FIG. 10 in which it is illustrated that the string detector for the coin-selecting device includes a switch means 10 conditioned to a first state by a string attached to a coin inserted into the device. This first state in FIG. 6 is illustrated by the existence of a light path, and is illustrated in FIG. 10 by the positioning of the switch arm 11 illustrated by broken lines. The switch means 10 in FIGS. 6 and 10 is conditioned to a second state by the absence of a string. This second state is illustrated in FIG. 6 by the blockage of the light path, and is illustrated in FIG. 10 by the position of switch arm 11 shown in full line.

A coin validation means generally referred to by 12 in FIGS. 6 and 10 is normally conditioned to a first state, and conditioned to a second state by a valid coin. The first state in the coin validation means of FIG. 6 is indicated by the absence of an output, while the second state is indicated by the presence of an output 13. In FIG. 10, the first state of the coin validation means is shown by the switch member 14 illustrated in full line, and the second state is indicated by the position of the switch member 14 as illustrated in broken lines.

In both of FIGS. 6 and 10, the switch means 10 and the coin validation means 12 are operatively interconnected for determining the handling of the coin depending upon the states of the switch means 10 and coin validation means 12.

Figure 1:
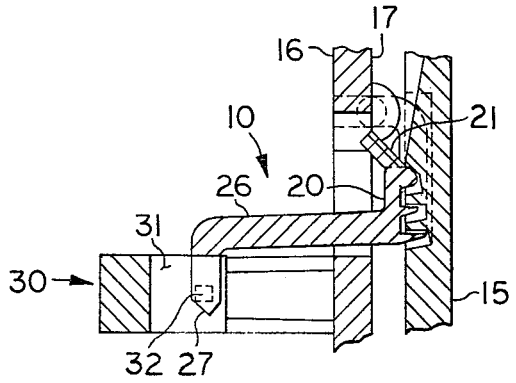
FIG. 1 is a fragmentary, cross-sectional view of the string detector switch means conditioned to its second state in the absence of a string.
Figure 2:
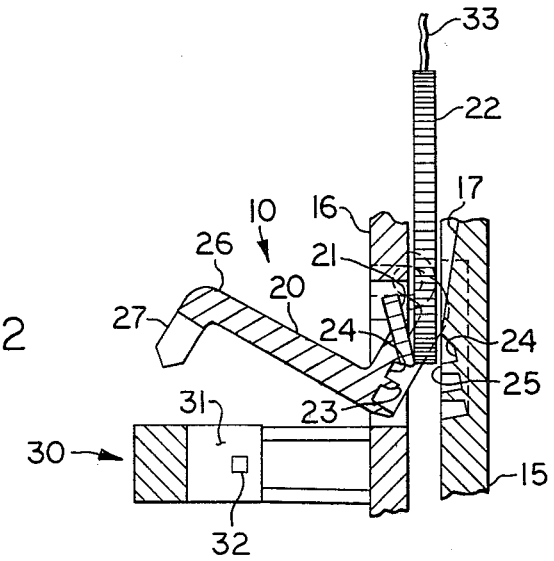
FIG. 2 is a fragmentary cross-sectional view, similar to FIG. 1, but showing the switch member moved from its first position and the switch means conditioned to its first state by a coin.
Figure 3:
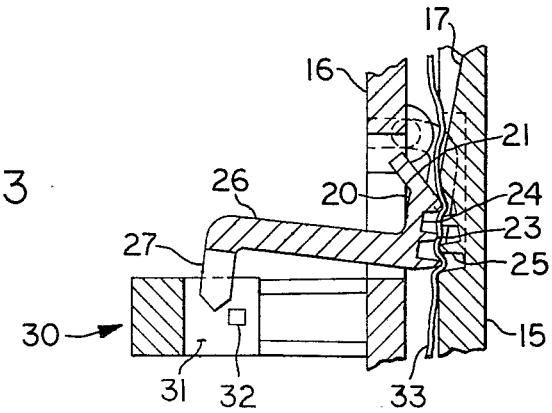
FIG. 3 is a fragmentary cross-sectional view of the string detector switch means conditioned to the said first state by engagement of the switch member with a string.
Figure 4:
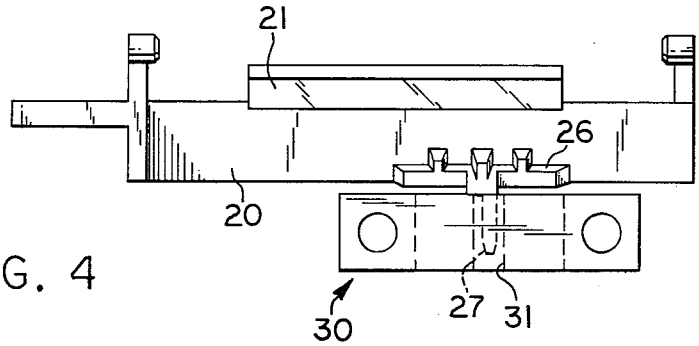
FIG. 4 is a front elevational view of the switch member of the string detector and of the cooperating optical limit switch.
Figure 5:
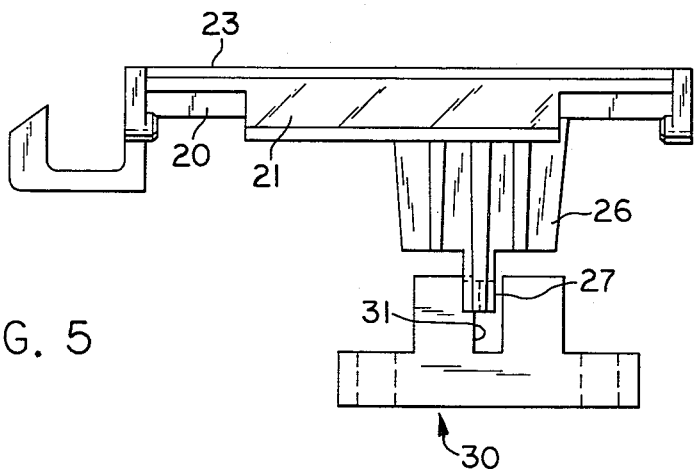
FIG. 5 is a top plan view of the switch member and optical limit switch shown in FIG. 4.

As illustrated in FIGS. 1–3, a gate 15 and a mainplate 16, constituting first and second elements, are relatively spaced to provide a coin chute 17 therebetween for receiving coins inserted into the device.

The switch means 10 shown in FIGS. 1–3 includes a switch member 20 pivotally mounted on the mainplate 16 and normally biased by its weight to a first position shown in FIG. 1 extending into and across the coin chute 17. The switch member 20 includes a cam 21 extending across the coin chute 17 in the said one position of the switch member 20 as illustrated in FIG. 1, a coin 22 engaging the cam 21 and moving the switch member pivotally from its said one position shown in FIG. 1 to another position illustrated in FIG. 2, as will appear upon later description of parts. When the switch member 20 is located in the said one position shown in FIG. 1, the switch means 10 is conditioned to its second state, and when moved from its one position to another position as illustrated in FIG. 2, the switch means 10 is conditioned to its said first state.

The inside face of the switch member 20 is provided with a plurality of ribs 23 and grooves 24 adapted to interfit respectively compatible grooves 24 and ribs 25 provided on the opposed face of the gate 15, when the switch member 20 is moved to its first position as illustrated in FIG. 1. The switch member 20 also includes a forwardly projecting portion 26 terminating in a switch arm 27.

The switch means 10 includes an optical limit switch referred to generally by 30, attached to and carried by the mainplate 16. It will be understood that various types of switches could be utilized, i.e., contact switches and the like, but the optical limit switch 30 is preferred. This optical limit switch 30 includes a slot 31 in which the switch arm 27 extends in the said one position of the switch member 20 illustrated in FIG. 1 so as to block the light path across the slot 31 emitting through the sensor apertures 32. Again, it will be understood that when the switch member 20 is moved from its said one position by a coin, as shown in FIG. 2, and also when prevented from returning to the said one position by the presence of a string 33 in the coin chute 17 as illustrated in FIG. 3, the switch means 10 is conditioned in its said first state in which the light path is not blocked by the switch arm 27.

In usage, when a coin 22 is inserted into the coin chute 17 of the device, it will strike the cam 21 of the switch member 20 and move the switch member 20 from the position illustrated in FIG. 1, in which the switch means 30 is conditioned to a second state by the interruption of the light path by the switch arm 27, to another position as illustrated in FIG. 2 in which the switch means 30 is conditioned to the first state by removing the switch arm 27 from the light path. The coin 22 will pass between the compatible ribs and grooves 23–25, and then will be subsequently tested by other mechanism for validity as will be later described.

If the coin 22 has no string 33 attached, the switch member 20 will move under its own weight or bias back to the one position shown in FIG. 1 in which the ribs and grooves 23–25 interfit and in which the switch arm 27 interrupts the light path, to condition the switch means 30 to the second state. However, if a string 33 is attached to the coin 22, the switch arm 20 is precluded from moving completely to the one position as shown in FIG. 1 by engagement of the ribs and grooves 23–25 with the string 33 therebetween, as is illustrated in FIG. 3. Accordingly, the switch member 20 is held from the said one position and the switch arm 27 remains out of the light path, and the switch means 30 is still conditioned in the second state.

As mentioned previously, after the coin 22 passes by the switch member 20 in chute 17, the coin 22 undergoes a series of tests to determine its validity. For example, such tests will determine, but are not limited to, whether or not the coin has serrations; whether or not the coin is of the appropriate size (both in diameter and thickness), and whether or not the coin has the appropriate metallic content. These tests to distinguish between genuine and non-genuine or counterfeit coins can be performed by detector devices such as is disclosed in copending U.S. patent application Ser. No. 850,943 and other electronic devices and detectors as disclosed in U.S. Pat. Nos. 3,952,851 and 3,966,034 among others. Such tests have been accomplished by mechanical means such as disclosed in U.S. Pat. Nos. 3,340,980, 3,592,307, 3,598,217, 3,991,867, 4,098,386 and 4,098,387 among others.

Referring to the block diagram of FIG. 6, it will be understood that a power supply 33 is connected to the optical limit switch 30 of the switch means 10. This optical limit switch includes an LED 34 at one side of the slot 31 that emits light to a phototransistor 35 through aligned apertures 32.

The means operatively interconnecting the switch means 10 and the coin validation means 12 includes a start-reset timer means 36 having a predetermined time interval in which the timer means 36 must be started by a coin 22 conditioning the switch means 10 to the first state, and subsequently reset by conditioning the switch means 10 to the second state. The timer means 36 is provided with a timer output 37 when the predetermined time interval is exceeded without the timer means 36 being reset, such as would be caused by maintaining the switch means 10 in the said first state by the presence of a string 33 between the ribs and grooves 23–25.

Figure 9:
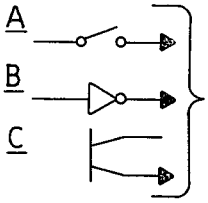
FIG. 9 illustrates various devices that can be used in the validation means for providing its output.

The coin validation means 12 provides an output 13 when conditioned to the said second state by a valid coin after the coin has undergone the desired validation tests described previously. This coin validation output 13 can be accomplished by any one of several means, some of which are suggested in FIG. 9; diagram A representing a mechanical switch, diagram B indicating an AND gate, and diagram C indicating an amplifier.

The outputs 37 of the timer means 36 and 13 of coin validation means 12 are connected to a means for sensing such outputs 37 and 13, as by a logic means 40 for determining the subsequent handling of the coin 22 by the device.

Figure 7:
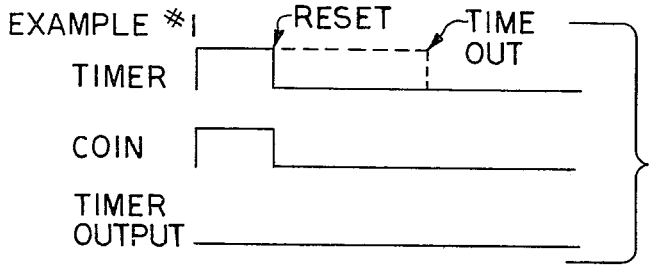
FIG. 7 is a diagram of an example No. 1 illustrating the operation of the start-reset timer by a coin.

Referring to FIG. 7, if a coin 22 without a string 33 attached is inserted into the coin chute 17, the coin 22 will move the switch member 20 to condition the switch means 10 to its second state to start the timing circuit of the timer means 36. After the coin 22 passes through the chute 17 and moves past the cooperating ribs and grooves 23–25, the switch member 20 will return to its one position shown in FIG. 1 so as to condition the switch means 10 to its first state and thereby reset the timer means 36 within the predetermined time interval. This predetermined time interval is shown by broken lines in the timer representation of this example (FIG. 7). Because the timer means 36 has been reset within the predetermined time interval, there is no timer output into the logic means 40. Even if the coin is valid and is so indicated by the coin validation means 12 to provide a coin validation means output 13 into the logic means 30, the logic means 40 will sense at this stage that there is no timer output, and the logic means 40 will cause acceptance or other predetermined manner of handling of the coin at that point.

Figure 8:
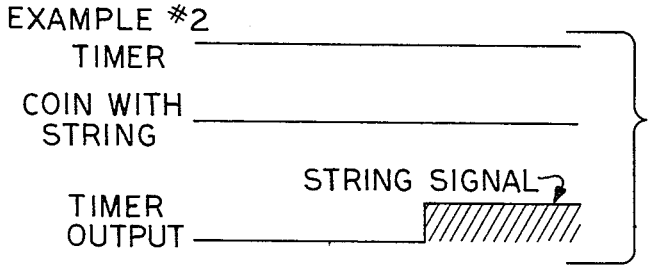
FIG. 8 is a diagram of an example No. 2 showing the operation of the timer by a coin with a string.

Referring to the example illustrated in FIG. 8, if a coin 22 with a string 33 attached is inserted into the coin chute 17, the coin 22 will move the switch member 20 from its one position shown in FIG. 1 to its position shown in FIG. 2 to condition the switch means 10 to the second state so that the circuit of the timer means 36 is started. After the coin 22 passes through the chute 17 and moves past the cooperating ribs and grooves 23–25, the switch member 20 is precluded from returning to its one position shown in FIG. 1 by engagement of the cooperating ribs and grooves 23–25 with the string 33 as indicated in FIG. 3. As a result, the switch means 10 is maintained in its first state by the engagement with the string 33, and the circuit of the timer means 36 is not reset within the predetermined time interval. When this predetermined interval expires, the circuit of timer means 36 provides an output 37 that is fed into the logic means 40. Again, even if the coin 22 to which the string 33 is attached, is a valid coin, and the coin validation means provides an output 13 that is also fed into the logic means 40, the logic means 40 will sense the presence of the timer output 37 and will then determine the subsequent handling of the coin from that point. For example, the logic means 40 could determine that the valid coin be passed into the cash box or returned to the customer through the coin rejection slot or cause any other predetermined manner of handling. In any event, the product will not be vended when there is a timer output 37 which is caused by the presence of a string 33 between the coacting ribs and grooves 23–25.

In the circuit diagram of the string detector of FIG. 10 the switch means is conditioned to a state as indicated by the position of the switch arm 11 in full line. After the coin 22 with an attached string 33 passes by the switch means 10, the switch arm 11 will then move back to the first position indicated by broken lines. After undergoing the desired validity tests, the coin validation means 12 will be conditioned to a state indicated by the switch arm 14 shown in broken lines. Because the switch means 10 is conditioned to a state in which the circuit is open, there will be no output. The coin 22 will then be accepted.

Figure 11:
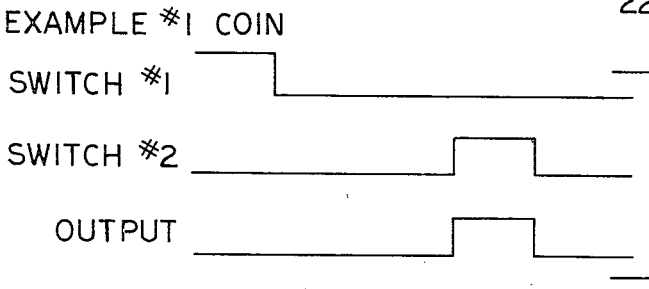
FIG. 11 is a diagram of example No. 1 showing the operation of the circuit of FIG. 10 when actuated by a coin.

This explanation of the operation of the circuit diagram of FIG. 10 by a valid coin 22 without a string 33 attached is illustrated diagrammatically in FIG. 11.

When a valid coin 22 with a string 33 attached is inserted into the coin chute, the coin 22 will be conditioned to a state as indicated by the position of switch arm 11 as shown in full line. Because a string 33 exist, the switch means 10 is maintained in this state. The coin validation means 12 is conditioned by the coin 22 to the state indicated by the position of switch arm 14 as indicated in broken lines. As a result, an output is provided in the circuit of FIG. 10 because of the particular states of the switch means 10 and coin validation means 12 in which the circuit is closed.

Figure 12:
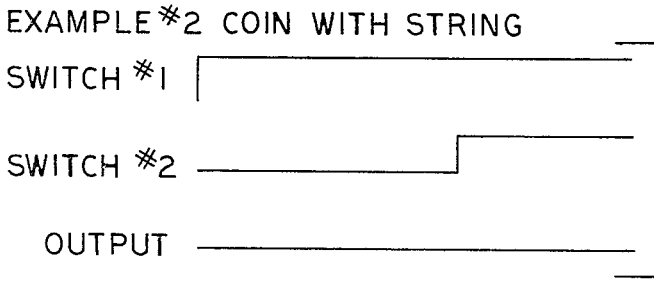
FIG. 12 is a diagram of example 2 illustrating the operation of the circuit of FIG. 10 by a coin with a string.

This operation of the string detector represented by the diagram of FIG. 10 with a coin 22 having a string 33 attached, is illustrated diagrammatically in FIG. 12. When an output exist, the manner of handling the coin 22 at that point can then be determined, i.e., either accepting the coin and passing it to a cash box without vending any product or returning the coin with the string attached to the customer.

I claim as my invention:

1. A string detector for a coin-selecting device, comprising:

(a) a switch means conditioned to a first state by engagement with and passage of a coin and maintained in the first state by engagement with a string attached to a coin inserted into the device, and conditioned to a second state by disengagement from and passage of a coin in the absence of a string, (b) coin validation means normally conditioned to a first state, and conditioned to a second state by a valid coin, and (c) means operatively interconnecting the switch means and coin validation means for determining the handling of the coin depending upon the state of the switch means and coin validation means.

2. A string detector for a coin-selecting device as defined in claim 1, in which:

(d) first and second elements are spaced to provide a coin chute therebetween for receiving coins inserted into the device, and (e) the switch means includes a switch member movably mounted on one of said elements and extending into the chute for engagement with and passage of a coin in the chute past the switch member for conditioning the switch means to the first state, the switch member and the other of said elements being provided with a selectively interfitting rib and groove in one position of the switch member when a string is absent between the rib and groove for conditioning the switch means to said second state, upon disengagement from and passage of the coin past the switch member, the switch member being held from said one position upon engagement with a string between the rib and groove for conditioning the switch means to the said first state upon passage of a coin with an attached string past the switch member.

3. A string detector for a coin-selecting device as defined in claim 1, in which:

(d) the means operatively interconnecting the switch means and coin validation means includes a start-reset timer means having a predetermined timed interval in which the timer means will be started by a coin engaging and conditioning the switch means to said first state, and subsequently reset by subsequent conditioning of the switch means to the second state upon disengagement of the switch means from and passage of a coin without an attached string, the timer means providing a timer output when the predetermined time interval is exceeded without having the timer means reset by maintaining the switch means in the said first state by the engagement of the switch means with a string attached to the coin, and, (e) the coin validation means provides an output when conditioned to said second state by a valid coin.

4. A string detector for a coin-selecting device as defined in claim 3, in which:

(f) means provides a coin chute for receiving coins inserted into the device, and (g) the switch means includes a movably mounted switch member extending into the chute and engageable with the coins passing through the chute, the switch member and chute means being provided with compatible ribs and grooves between which the coins pass, the ribs and grooves selectively interfitting in one position of the switch member when a string is absent from between the ribs and grooves for conditioning the switch means to said second state, the switch member being held from said one position by engagement of a string between the ribs and grooves for maintaining the switch means in said first state.

5. A string detector for a coin-selecting device, comprising:

(a) a switch means conditioned to a first state by a string attached to a coin inserted into the device, and conditioned to a second state by the absence of a string, (b) coin validation means normally conditioned to a first state, and conditioned to a second state by a valid coin, (c) means operatively interconnecting the switch means and coin validation means for determining the handling of the coin depending upon the state of the switch means and coin validation means, (d) first and second elements spaced to provide a coin chute therebetween for receiving coins inserted into the device, (e) the switch means including a switch member movably mounted on one of said elements, the switch member and the other of said elements being provided with a selectively interfitting rib and groove in one position of the switch member when a string is absent between the rib and groove for conditioning the switch means to said second state, the switch member being movable from said one position upon engagement with a string between the rib and groove for conditioning the switch means to the said first state, and (f) the movably mounted switch member including a cam extending into the chute and engageable by the coin for moving the switch member from said one position for allowing passage of the coin along the chute and between the rib and the groove, the switch member being biased and tending to move back to said one position after passage of the coin.

6. A string detector for a coin-selecting device as defined in claim 5, in which:

(f) a plurality of compatible interfitting ribs and grooves are provided on both the said other element and the movable switch member.

* * * * *